United States Patent [19]

Nagasaku et al.

[11] 4,447,196

[45] May 8, 1984

[54] ROTARY VANE COMPRESSOR WITH VALVE CONTROL OF UNDERVANE PRESSURE

[75] Inventors: Eiichi Nagasaku, Chiryu; Kimihiro Kato; Masao Yasunaga, both of Kariya, all of Japan

[73] Assignee: Nippondenso Co., Ltd., Kariya, Japan

[21] Appl. No.: 271,382

[22] Filed: Jun. 8, 1981

[30] Foreign Application Priority Data

Feb. 16, 1981 [JP] Japan ..... 56-21706

[51] Int. Cl.[3] ..... F04C 18/00; F04C 29/02; F04C 29/10

[52] U.S. Cl. ..... 418/93; 418/268

[58] Field of Search ..... 418/82, 84, 87, 93, 418/267–269

[56] References Cited

U.S. PATENT DOCUMENTS 2,193,177 3/1940 Laythorpe ..... 418/87

3,516,768 6/1970 Bolz et al. ..... 418/82

4,260,343 4/1981 Watanabe et al. ..... 418/269

*Primary Examiner*—John J. Vrablik

*Attorney, Agent, or Firm*—Cushman, Darby & Cushman

[57] ABSTRACT

A vane type rotary compressor has a housing and end plates secured thereto to cooperate therewith to define a cylindrical bore in which a rotor is eccentrically mounted for rotation with vanes slidably mounted in vane grooves formed in the outer periphery of the rotor. A lubricant groove is formed in the inner surface of one end plate and so disposed as to be brought into communication with the inner end portions of the vane grooves pertaining to vanes defining working chambers when in their intake phases. The lubricant groove is connected by a passage with a discharge chamber of the compressor so that fluid pressure is fed into the inner end portions of the vane grooves to urge the vanes into sealing engagement with the inner peripheral surface of the cylindrical bore. A valve is provided to disconnect the discharge chamber from the lubricant groove during normal compression operation of the compressor.

8 Claims, 13 Drawing Figures

ROTARY VANE COMPRESSOR WITH VALVE CONTROL OF UNDERVANE PRESSURE

BACKGROUND OF THE INVENTION

1. Field of the Invention

The present invention relates to a rotary compressor which can be used, but not restrictively, as a refrigerant compressor of a vehicular air conditioning system.

2. Description of the Prior Art

In the conventional rotary refrigerant compressor, the lubricant groove in one of the end plates of the compressor housing tends to be sealed from the lubricant supply source when the compressor is started with a result that pressure drop takes place behind the inner ends of vanes slidably received in the vane grooves in the rotor and thus the vanes do not quickly move outwardly from the rotor as the latter is rotated. For this reason, the radially outer ends of the vanes are not kept in intimate sealing engagement with the inner peripheral surface of the housing during rotation of the rotor, so that the compressor falls short of satisfactorily compressing the refrigerant.

SUMMARY OF THE INVENTION

It is an object of the present invention to solve the problem discussed above.

According to the present invention, there is provided a rotary compressor which comprises:

a housing having an inner peripheral surface;

first and second end plates sealingly secured to the opposite ends of said housing to cooperate therewith to define a bore;

a rotor mounted eccentrically in said bore for rotation therein and provided with a plurality of vane grooves formed in the outer peripheral surface of said rotor;

vanes slidably mounted in said vane grooves, respectively;

said inner peripheral surface, said end plates, said rotor outer surface and said vanes cooperating to define a plurality of working chambers the volumes of which are varied during rotation of said rotor, each cycle of revolution of each working chamber about the axis of said rotor including intake and compression strokes or phases in which the volume of the working chamber is gradually expanded and gradually decreased, respectively;

an intake port means open to said bore and so disposed as to be communicated with the working chambers when they are in their intake strokes or phases;

a discharge port means open to said bore and so disposed as to be communicated with the working chambers when they are in the final stages of their compression phases;

means cooperating with one of said end plates to define a discharge chamber and a lubricant reservoir communicated therewith, said discharge chamber being communicated with said discharge port means, said lubricant reservoir being provided at the bottom of said discharge chamber;

said one end plate being provided with a lubricant groove formed in the surface thereof facing to said rotor, said lubricant groove being disposed such that the inner end portions of the vane grooves pertaining to vanes which define working chambers when in their intake phases are communicated with said lubricant groove, said lubricant groove being adapted to be supplied with lubricant from said lubricant reservoir;

said one end plate being also formed therein with a passage for the communication of said lubricant groove with said discharge chamber so that said lubricant groove and thus the inner end portions of respective vane grooves are supplied with fluid pressure from said discharge chamber;

valve means operative to interrupt the communication between said lubricant groove and said discharge chamber during normal compression operation of said compressor.

The fluid pressure in the discharge chamber of the compressor, therefore, can be utilized to positively move the vanes outwardly into sealing contact with the inner peripheral surface of the cylindrical bore in the housing at the time when the compression operation of the compressor has just been started. During the normal compression operation of the compressor, however, the communication between the lubricant groove and the discharge chamber of the compressor is interrupted by the valve so that the vanes are prevented from being urged against the inner surface of the cylindrical bore by an unduly high pressure.

The above and other objects, features and advantages of the present invention will be made more apparent by the following description with reference to the accompanying drawings.

DESCRIPTION OF PREFERRED EMBODIMENTS

Figure 1:
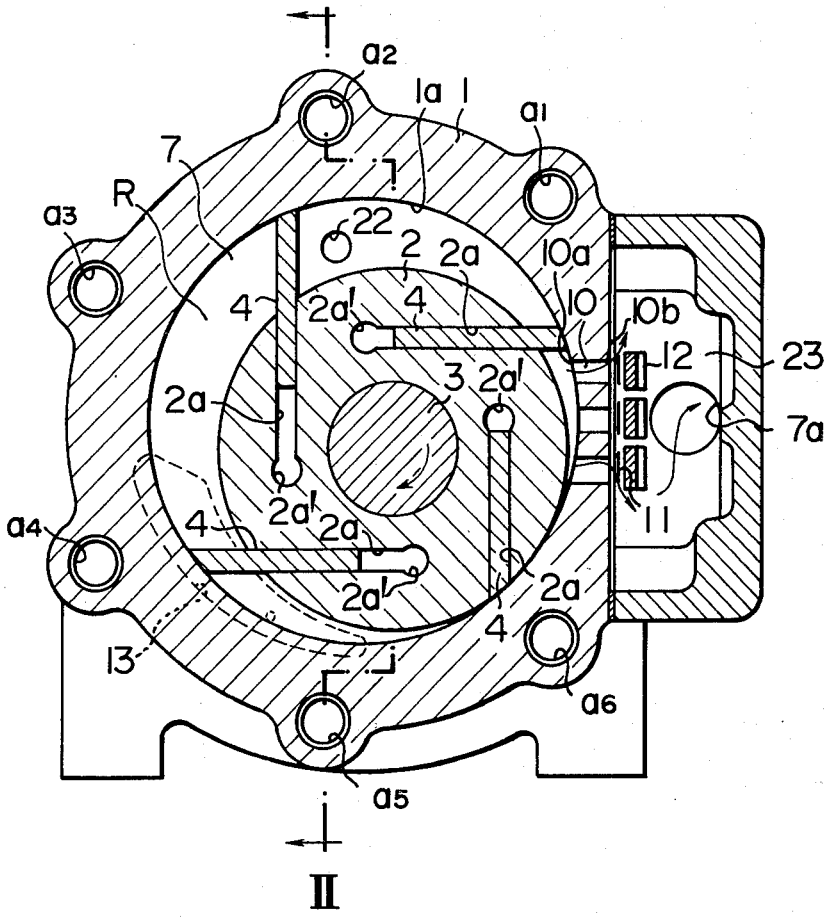
FIG. 1 is a sectional view of an embodiment of the rotary compressor according to the present invention taken along line I—I in FIG. 2.
Figure 3:
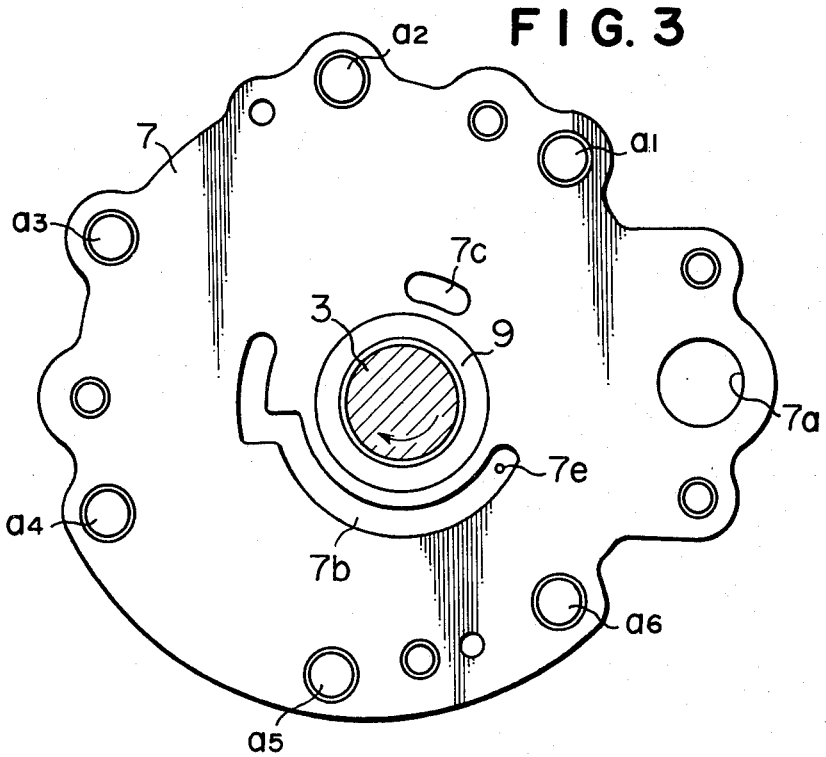
FIG. 3 is an end view of an end plate taken along line III—III in FIG. 2.
Figure 2:
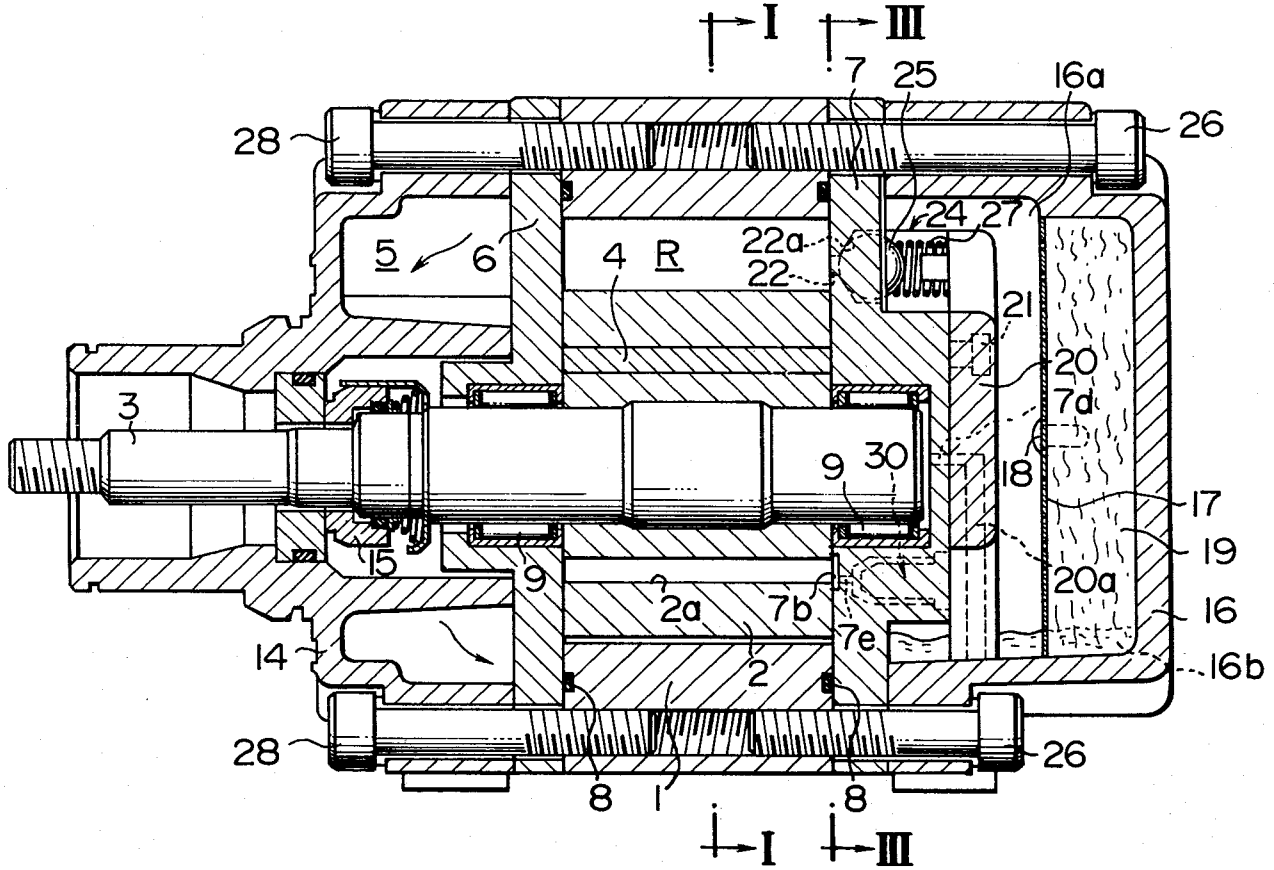
FIG. 2 is an axial sectional view of the rotary compressor taken along line II—II in FIG. 1.

Referring first to FIGS. 1–3, a housing 1 has a cylindrical inner peripheral surface 1*a*. A rotor 2 is rotatably and eccentrically mounted in the housing 1. A rotor shaft 3 is press-fitted into an axial bore in the rotor 2 and is rotatable therewith. Four vane grooves 2*a* are formed in the outer pheriphery of the rotor 2 in circumferentially equally spaced relationship. Vanes 4 are slidably mounted in respective vane grooves 2*a*.

End plates 6 and 7 are secured to the opposite ends of the housing 1 with O-rings 8 and 8 interposed therebetween. The shaft 3 is rotatably mounted on the end plates 6 and 7 by means of bearings 9 and 9 fixed thereto.

The housing end plates 6 and 7, the inner peripheral surface 1*a* of the housing, the outer peripheral surface of the rotor 2 and each adjacent pair of vanes 4 cooperate together to define a working chamber R whose volume is varied as the rotor 2 is rotated. The housing 1 is formed therein with discharge ports 10 having inner ends 10*a* open in the inner peripheral surface 1*a* of the housing 1 and outer ends 10*b* open toward discharge valve means 11 disposed in a refrigerant discharge chamber 23. A stop 12 is provided in the discharge chamber 23 to limit the movement of the discharge valve means 11.

First and second lubricant grooves 7*b* and 7*c* are formed in the inner surface of the end plate 7 which will be termed as "rear end plate" hereunder. The lubricant grooves 7*b* and 7*c* are respectively so located as to be brought into communication with the bottom portions 2*a*' of the vane grooves 2 when the rotor is rotated. More specifically, the first lubricant groove 7*b* is located in the suction or intake stroke (phase) zone where each working chamber R is progressively expanded; namely, the groove 7*b* is disposed in a zone extending from a position in which a vane 4 has just passed over the discharge ports 10 and retracted into the groove 2*a* to its innermost position to a position in which the working chamber R has been expanded to its maximum volume and the vane 4 has been displaced or extended to its outermost position. The second lubricant groove 7*c* is disposed to extend over a predetermined circumferential angular range in an intermediate zone of compression stroke (phase) zone where the volume of the working chamber R is progressively reduced.

A cup-shaped front end cover 14 (termed hereunder as "front cover") is sealingly secured to the end plate 6 (termed hereunder as "front end plate"). The front cover 14 is formed therein with an intake port (not shown) through which the refrigerant from an evaporator (not shown) flows into an intake chamber 5 defined in the front cover 14. The refrigerant then flows into a working chamber R through an inlet opening 13 formed in the end plate 6.

A mechanical seal 15 is provided between the front cover 14 and the shaft 3 to prevent leakage of the lubricant and refrigerant.

A cup-shaped rear end cover 16 (termed hereunder as "rear cover") is sealingly secured to the rear end plate 7 to cooperate therewith to define a second refrigerant discharge chamber 16*a* communicated with the discharge chamber 23 through a discharge passage 7*a*. A filter plate 17 of a porous plate is disposed within the rear cover 16 and secured thereto by means of a screw 18. The space defined between the filter plate 17 and the rear cover 16 is filled with an oil separator 19 formed of non-woven metal filaments arranged in a complex three-dimensional structure.

A plate 20 is secured to the outer surface of the rear end plate 7 by means of bolts (one of which is shown at 21). The plate 20 is formed therein with a lubricant passage 20*a* which communicates a lubricant hole 7*d* in the end plate 7 with a lubricant reservoir 16*b* formed by the lower part of the rear cover 16 so that the lubricant is fed from the reservoir 16*b* through the lubricant passage 20*a* and the lubricant hole 7*d* to the right end face of the shaft 3 due to the pressure difference between the reservoir 16*b* (i.e., the second refrigerant discharge chamber 16*a*) and the space adjacent to the right end face of the shaft 3. The lubricant supplied to the right end face of the shaft then flows through the righthand bearing 9 into gap between the adjacent end face of the rotor 2 and the inner surface of the end plate 7 to lubricate the rotor end face as well as the righthand bearing 9. A part of the lubricant thus supplied is accumulated in the lubricant grooves 7*b* and 7*c* so that the lubricant thus accumulated can flow into the bottom portions 2*a*' of the vane grooves 2 when the lubricant grooves are communicated with the vane groove bottom portions 2*a*', and then flow therefrom to the gap between the end plate 6 and the rotor 2.

The rear end plate 7 is also formed therein with a communication aperture 7*e* for communicating the lubricant groove 7*b* adjacent to its leading end with the discharge chamber 16*a* in the end cover 16.

The housing 1, end plates 6 and 7 and the front and rear covers 14 and 16 are all made of an aluminum alloy and tightly secured together by bolts 26 and 28 extending through the front and rear covers and the end plates into bolt-receiving drilings $a_1$ to $a_6$ formed in the peripheral wall of the housing 1.

The rear end plate 7 is formed therein with a communication port 22 for communicating working chambers R with the discharge chamber 16*a* in the rear end cover 16. The communication port 22 is disposed in the zone in which a compression stroke of each working chamber R is initiated, i.e., in which the working chamber R is in its initial stage of compression stroke and is not communicated with the discharge ports 10 yet. A check valve 24 is disposed in the communication port 22 and is operative to be open to release the refrigerant from the working chamber R into the discharge chamber 16*a* only when the pressure in the working chamber R exceeds the pressure in the discharge chamber 16*a* by a predetermined pressure (for example, from 1 to 5 atm. and preferably about 1 atm.).

As will be seen in FIG. 2, the check valve 24 comprises a valve member 25 of steel ball normally urged by a compression coil spring 27 against a concave annular surface of valve seat 22*a* extending around the communication port 22. The coil spring 27 extends between the steel ball 25 and the above-mentioned plate 20 secured to the outer end face of the end plate 7.

In operation, when the rotor shaft 3 is rotated by a driving means such as an automotive engine (not shown), the rotor 2 and the vanes 4 are rotated with the shaft 3 to vary the volume of each of the working chambers R. The refrigerant which has been introduced into the intake chamber 5 in the front end cover 14 from the refrigeration cycle (not shown) is sucked from the intake chamber 5 through the intake port 13 into a working chamber R which is being expanded. The rotation of the rotor 2 then moves this working chamber R out of communication with the intake port 13 and brings the working chamber into a compression stroke zone where the volume of the chamber is reduced to subject the refrigerant therein to compression. When the volume of the working chamber R is reduced to its minimum value, the chamber is communicated with the discharge ports 10 so that the compressed refrigerant is discharged through the discharge ports 10 and the discharge valve 11 into the discharge chamber 23.

The discharged refrigerant then flows from the discharge chamber 23 into the discharge chamber 16*a* through the discharge passage 7*a* formed in the rear end plate 7. The refrigerant then flows through the oil separator 19 for separating the lubricant oil from the refrigerant and thereafter passes through passages (not shown) into a condenser (not shown) of the refrigeration cycle. The separated lubricant oil is collected in the reservoir 16*b* and subject to the refrigerant pressure in the chamber 16*a*.

During the operation of the compressor, the vanes 4 are outwardly extended from respective vane grooves 2*a* chiefly by the centrifugal forces into sliding contact with the inner peripheral surface 1*a* of the rotor housing 1. The fluid pressures in the lubricant grooves 7*b* and 7*c* formed in the inner surface of the end plate 7 add to the centrifugal forces to urge the vanes into sealing engagement with the inner peripheral surface 1*a* of the rotor housing 1. More specifically, when the vanes 4 are in the intake stroke zone where the vanes are to be outwardly driven, the vanes are subjected to the pressure in the lubricant groove 7*b* which adds to the centrifugal forces to urge the vanes into sealing engagement with the inner peripheral surface 1*a* of the rotor housing. When the vanes are moved into the intermediate section of the compression stroke zone where the vanes are moved inwardly into the vane grooves, the second lubricant groove 7*c* in the end plate 7 is communicated with the vane grooves 2*a* so that the inner end portions 2*a*' of the vane grooves are supplied with lubricant oil. The vanes 4, therefore, are moved inwardly in the vane grooves to press the fluid in the inner end portions 2*a*' of the vane grooves and thus are held in intimate sealing engagement with the inner peripheral surface 1*a* of the rotor housing 1 by the fluid pressure in the inner end portions 2*a*' of the vane grooves 2*a*.

As discussed above, the fluid pressure in the lublicant grooves 7*b* and 7*c* provided in the rear end plate 7 is effective to keep the outer ends of the vanes 4 in sliding engagement with the inner peripheral surface 1*a* of the rotor housing 1 in both intake and compression strokes. Accordingly, the bounce of the vanes in the vane grooves is prevented to assure smooth and quiet rotor operation.

The above-mentioned communication aperture 7*e* communicates the lubricant groove 7*b* with the discharge chamber 16*a* and thus is operative to prevent the lubricant groove 7*b* from being sealed when the compressor is started. The pressure in the inner end portions 2*a*' of the vane grooves 2*a*, therefore, is prevented from being lowered when the rotor operation is commenced, to thereby assure that the vanes 4 are smoothly extended outwardly to begin a smooth compression operation.

If, however, the lubricant groove 7*b* is always communicated through the communication aperture 7*e* with the discharge chamber 16*a*, the fluid pressure acting on the inner ends of the vanes would be unduly increased during normal operation of the compressor and thus will disadvantageously increase the power required to drive the compressor. For this reason, a valve means 30 is provided to control the communication between the lubricant groove 7*b* and the discharge chamber 16*a*.

Figure 4:
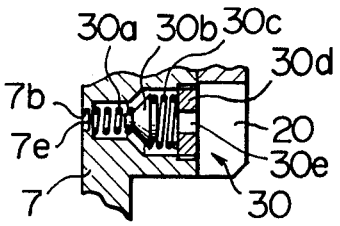
FIG. 4 is an enlarged fragmentary sectional view of the end plate showing valve means for controlling the communication between a lubricant groove in the end plate and a refrigerant discharge chamber.

With reference to FIG. 4, the valve means 30 includes a valve member 30*b* resiliently supported between first and second springs 30*a* and 30*c*. The spring 30*c* is supported by a retainer 30*d* having a communication opening 30*e* formed therein. The valve means 30 is arranged such that the valve member 30*b* is held at its open position when the pressures in the lubricant groove 7*b* and in the discharge chamber 16*a* are substantially equal as is experienced when the operation of the compressor is started and such that the valve member is moved into sealing engagement with an associated valve seat by more than a predetermined pressure difference which is produced across the valve means 30 when the compressor is in its normal operation. The spring retainer 30*d* can be threadably rotated to adjust the pressure exerted by the spring 30*c* to the valve member 30*b*.

Figure 5:
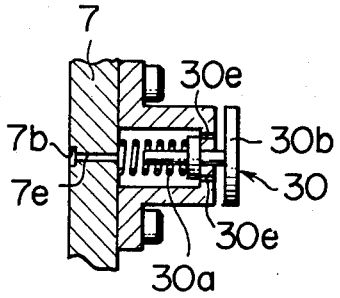
FIGS. 5 to 7 are similar to FIG. 4 but illustrate modifications of the valve means shown in FIG. 4.
Figure 6:
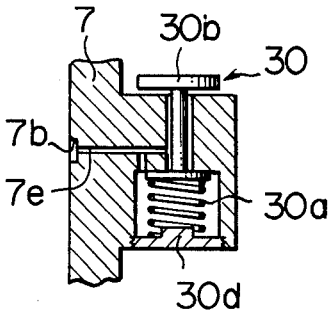
Figure 7:
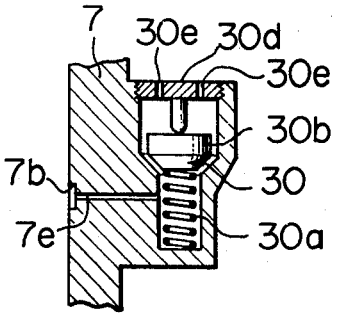
Figure 8:
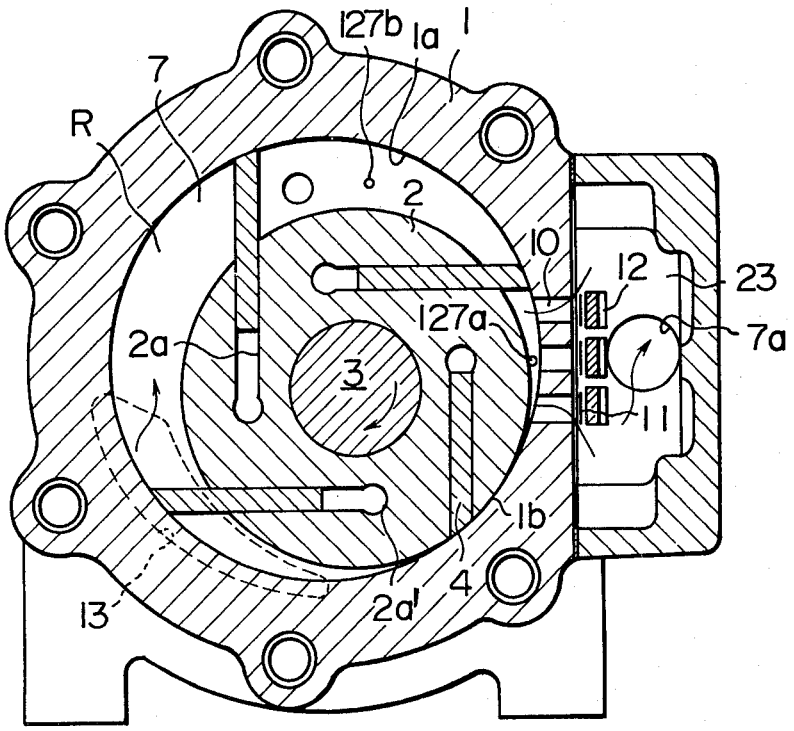
FIG. 8 is similar to FIG. 1 but illustrates a rotor and a housing of a second embodiment of the rotary compressor according to the invention.
Figure 9:
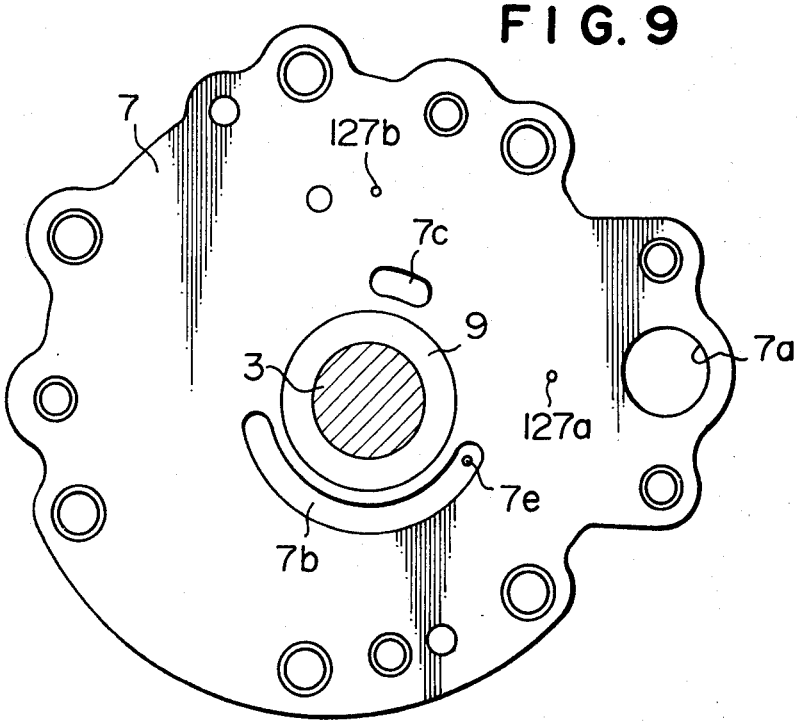
FIG. 9 is an end view of an end plate of the housing of the second embodiment of the rotary compressor.
Figure 10:
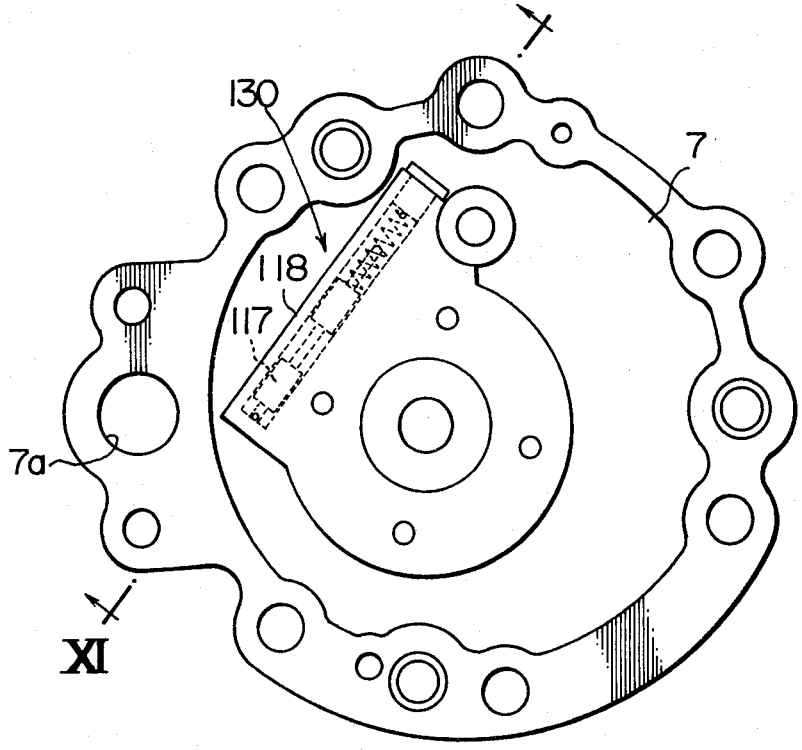
FIG. 10 is the other end view of the end plate shown in FIG. 9.

FIGS. 5, 6 and 7 illustrate modifications of the valve means 30 shown in FIG. 4. Parts of the modified valve means 30 functionally similar to those of the valve means 30 shown in FIG. 4 are designated by similar reference numerals.

In the illustrated embodiment of the rotary compressor, the lubricant grooves 7*b* and 7*c* have been described as being formed in the rear end plate 7. However, the front end plate 6 can alternatively be formed with such lubricant grooves to provide a similar advantage provided that the rotor shaft 3 is formed therein with a lubricant passage to guide the lubricant from the lubricant reservoir 16*b* through the passage to the bearing 9 adjacent to the front end plate and thus to the gap between the rotor 2 and the front end plate. In this alternative case, the front end plate 6 may also be formed therein with a communication aperture to communicate the lubricant groove thus formed with a refrigerant passage section in the front end cover 14.

In addition, the number of the vanes 4 is not limited to four as in the illustrated embodiment of the invention.

Figure 11:
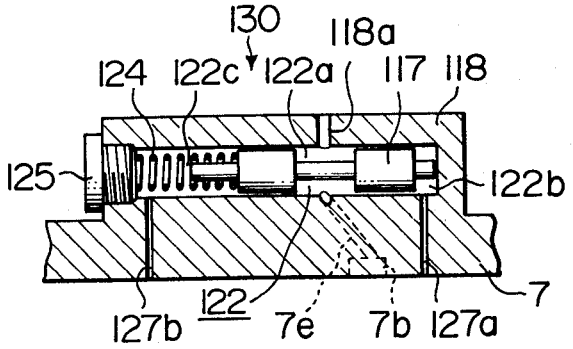
FIG. 11 is an enlarged sectional view taken along line XI—XI in FIG. 10 showing further modified valve means for controlling the communication between the lubricant groove and the refrigerant discharge chamber.
Figure 12:
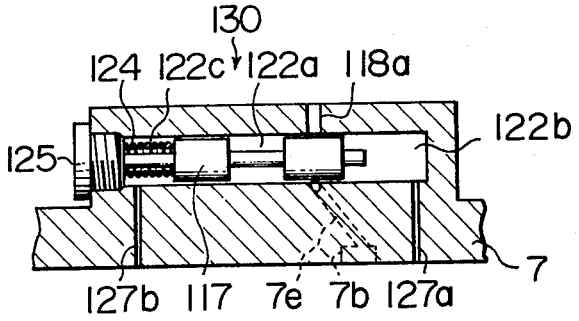
FIG. 12 is similar to FIG. 11 but illustrates components of the valve means in different positions.

FIGS. 8 to 13 illustrate a second embodiment of the rotary compressor according to the present invention. The parts of the second embodiment similar to those of the first embodiment are designated by similar reference numerals for the purpose of simplification of description. The difference only will be described hereunder. The rear end plate 7 is formed with a communication aperture 7*e* as in the first embodiment. The communication between the communication aperture 7*e* and the discharge chamber 16*a* (see FIG. 2) is controlled by a control valve means 130 the details of which are shown in FIGS. 11 and 12.

The valve means 130 includes a spool valve member 117 slidably disposed in a valve chamber 122 defined by a valve support 118 which is integral with the rear end plate 7. The valve chamber 122 is closed by a plug 125 threadably rotatable to adjust the spring force of a spring 124 disposed in the valve chamber 122 and extending between the plug 125 and the valve member 117. The communication aperture 7*e* extends between the lubricant groove 7*b* and the valve chamber 122. A second communication aperture 118*a* is formed in the valve support 118 to communicate the valve chamber 122 with the discharge chamber 16*a* in the rear end cover 16. The second communication aperture 118*a* is positioned in alignment with the end of the first communication aperture 7*e* which is open to the valve chamber 122. The first and second communication apertures 7*e* and 118*a* are substantially of the same inner diameters (about 2 mm, for example). The valve member 117 has axially aligned two lands which cooperate with the valve support 118 and the plug 125 to divide the valve chamber 122 into the first to third chambers 122*a*, 122*b* and 122*c*. The valve member 117 is axially movable in the valve chamber 122 between a first position in which the first and second communication apertures 7e and 118a are communicated with each other through the chamber 122a and a second position in which one of the lands of the valve member 117 blocks the communication between the two communication apertures 7e and 118a. The spring 124 exerts to the valve member 117 a predetermined pressure (4 to 5 kg/cm$^2$, for example) in the rightward direction as viewed in FIGS. 11 and 12. The second and third chambers 122b and 122c may be called as "first and second pressure spaces" for the reason to be made apparent later.

The rear end plate 7 is further formed therein with first and second pressure passages 127a and 127b through which the chambers 122b and 122c in the valve support 118 are communicated with working chambers R in the rotor housing 1 so that the valve member 117 is moved in the valve chamber 122 in a direction which is determined in dependence on the difference between the fluid pressures existing in the chambers 122b and 122c and acting on the opposite ends of the valve member 117 and the pressure exerted by the spring 124 to the left end face of the valve member. The first pressure passage 127a is disposed at a position in which the pressure in each working chamber R is highest; namely, the passage 127a is located at a point which is angularly offset by substantially 45° toward the discharge openings 10 from the point 1b where the rotor 2 is closest to the inner peripheral surface 1a of the rotor housing 1. The second pressure passage 127b is disposed at a position where the volume of each working chamber R is slightly reduced; namely, the passage 127b is angularly offset by substantially 130° from the point 1b to the trailing side thereof. Thus, the first and second pressure passages 127a and 127b will never be opened simultaneously to the same working chamber R, so that the fluid pressures acting on the opposite end faces of the valve member 117 will never be at the same levels. Alternatively, the first and second pressure passages 127a and 127b may be so located as to be opened simultaneously to the same working chamber R over a very small angle of rotor revolution provided that the fluid pressures in the chambers 122b and 122c do not become equal. The first and second passages 127a and 127b are not limited to the positions described above and may be disposed anywhere provided that there is produced a substantial pressure difference between the chambers 122b and 122c.

With the described construction and arrangement of the second embodiment of the rotray compressor, no pressure difference exists between respective working chambers R at the moment when the compressor is to be started. At this time, therefore, the difference between the fluid pressure in the chamber 122b and the fluid pressure in the chamber 122c is less than the predetermined pressure determined by the spring 124, so that the valve member 117 is located at the rightmost position shown in FIG. 11 in which the lubricant groove 7b in the end plate 7 is communicated through the communication aperture 7e, the chamber 122a and the second communication aperture 118a with the discharge chamber 16a whereby the lubricant groove 7b is prevented from being sealed at this stage of the compressor operation. Accordingly, the pressure in the inner end portions 2a' of the vane grooves 2a is prevented from being lowered. Thus, the vanes 4 are smoothly moved outwardly along the vane grooves 2a by the centrifugal forces into sealing engagement with the inner peripheral surface 1a of the rotor housing 1 to thereby facilitate a smooth starting of the compression operation of the compressor.

After the compression operation has been started and a pressure difference is produced between respective working chambers R so that the difference in pressure between the chambers 122b and 122c exceeds the predetermined pressure determined by the spring 124, the valve member 117 is moved leftward against the spring 124 to a position in which the communication between the first and second communication apertures 7e and 118a is interrupted by the valve member so that the first lubricant groove 7b is sealed, as shown in FIG. 12. For this reason, the communication between the discharge chamber 16a with the lubricant groove 7b is blocked during the normal operation of the compressor to prevent the refrigerant in the discharge chamber 16a at a high temperature and pressure from being leaked through the communication aperture 7e into the lubricant groove 7b for thereby eliminating drop of the compressor efficiency which would otherwise be caused by such leakage.

When the rotation of the rotor of the compressor is stopped, the pressures in the respective working chambers R will be equalized in a relatively short period of time so that the pressure difference between the chambers 122b and 122c becomes smaller than the predetermined pressure determined by the spring 124 whereby the valve member 117 is again moved to the rightmost position shown in FIG. 11. For this reason, even if the compressor operation is restarted after the lapse of a short period of time from the stoppage of the compressor operation, the vanes can be smoothly moved to its operative positions to seal the working chambers R one from another.

The valve means 130 is more advantageous than the valve means 30 shown in FIGS. 4–7 because the valve means 130 utilizes the fluid pressure produced in two working chambers R to actuate the valve member 117 and thus is reliably responsive to variation in the fluid pressure produced in the rotary compressor to assure a smooth restarting of compression operation.

In the event where the compressor operation is slowed down or in an instance where either the evaporation pressure in the evaporator is raised or the condensation pressure in the condenser is lowered due to some reason occured during the operation of the refrigeration cycle with a result that the difference between the pressure of the refrigerant at the intake port of the compressor and the pressure of the refrigerant at the discharge port thereof is decreased, there occurs a decrease in the difference between the pressure produced in the chamber 122c of the valve means 130 by the refrigerant supplied through the pressure passage 127b into the chamber 122c from a working chamber R when in its initial stage of compression stroke, and the pressure produced in the chamber 122b of the valve means 130 by the refrigerant supplied through the pressure passage 127a into the chamber 122b from another working chamber R when in its final stage of the compression stroke. As a result, the valve member 117 is rightwardly moved by the spring 124 from the position shown in FIG. 12 to the position shown in FIG. 11 to allow the communication apertures 7e and 118a to be communicated with each other. As described, when the difference between the refrigerant pressures at the intake and discharge ports of the compressor is decreased beyond a predetermined value, the valve means 130 is opened to communicate the communication apertures 7e and 118a so that a high fluid pressure is introduced from the discharge chamber 16*a* through the communication apertures 118*a* and 7*e* and through the lubricant groove 7*b* into the inner portions 2*a*' of the vane grooves 2*a* to reliably urge the vanes 4 against the inner peripheral surface 1*a* of the rotor housing 1.

Figure 13:
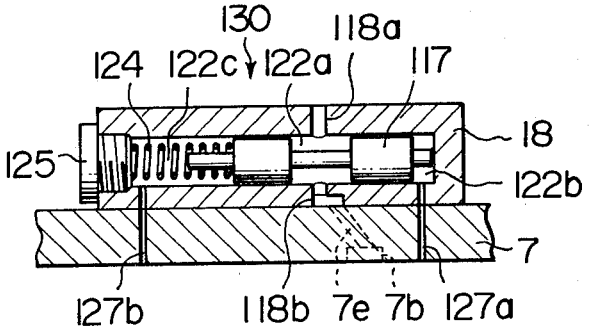
FIG. 13 is similar to FIG. 11 but illustrates a further modified form of the valve means.

In the embodiment shown in FIGS. 11 and 12, the valve support 118 is shown as being integral with the rear end plate 7. The valve support, however, may alternatively be prepared separately of the end plate 7 and secured thereto, as shown in FIG. 13. Further alternatively, the valve support 118 may be integral with the plate 20 (see FIG. 2) attached to the outer surface of the end plate 7.

In the illustrated embodiment of the invention, the valve member 117 of the valve means 130 is made of iron but may alternatively be made of aluminium or an aluminium-based alloy. The valve member 117 is shown as being movable in a direction parallel to the rear end plate 7. This is not the essential feature of the invention and the direction of the movement of the valve member may be perpendicular or oblique relative to the end plate 7 to provide a similar functional advantage.

The communication aperture 7*e* and the valve means 130 have been described and illustrated as being provided in and on the rear end plate 7 but may alternatively be provided in and on the front end plate 6. In the alternative case, the front end plate 6 should be formed therein with a lubricant groove which is similar to the lubricant groove 7*b* and adapted to be communicated with a refrigerant passage formed in the front end cover 14.

Moreover, the valve means 130 is not limited to the structure shown and may be of any other form which is responsive to a predetermined pressure difference to control the communication between the lubricant groove 7*b* and the discharge chamber 16*a*. As an example, the valve means 130 may be a diaphragm-actuated valve or a solenoid valve.

What is claimed is:

1. A rotary compressor for gas comprising:

a housing having an inner peripheral surface;

first and second end plates sealingly secured to the opposite ends of said housing to cooperate therewith to define a bore;

a rotor mounted eccentrically in said bore for rotation therein and provided with a plurality of vane grooves formed in the outer peripheral surface of said rotor;

vanes slidably mounted in said vane grooves, respectively;

said inner peripheral surface, said end plates, said rotor outer surface and said vanes cooperating to define a plurality of working chambers the volumes of which are varied during rotation of said rotor, each cycle of revolution of each working chamber about the axis of said rotor including intake and compression phases in which the volume of the working chamber is gradually expanded and gradually decreased, respectively;

an intake port means open to said bore and so disposed as to be communicated with the working chambers when they are in their intake phases;

a discharge port means open to said bore and so disposed as to be communicated with the working chambers when they are in the final stages of their compression phases;

means cooperating with one of said end plates to define a discharge chamber and a lubricant reservoir communicated therewith, said discharge chamber being communicated with said discharge port means, said lubricant reservoir being provided at the bottom of said discharge chamber and adapted to contain lubricant under the pressure of the compressed and discharged fluid in said discharge chamber;

said one end plate being provided with a lubricant groove formed in the surface thereof facing to said rotor, said lubricant groove being disposed such that the inner end portions of the vane grooves pertaining to vanes which define working chambers when in their intake phases are communicated with said lubricant groove;

means for guiding the lubricant under pressure from said reservoir into said lubricant groove;

said one end plate being also formed therein with a passage for the communication of said lubricant groove with the gas in said discharge chamber so that said lubricant groove and thus the inner end portions of respective vane grooves are supplied with fluid pressure from said discharge chamber;

valve means operative to interrupt the communication in said passage between said lubricant groove and said discharge chamber during normal compression operation of said compressor.

2. A rotary compressor as defined in claim 1, wherein said valve means includes a valve seat provided between said communication passage and said discharge chamber, a valve member movable toward and away from said valve seat, and means resiliently biasing said valve member away from said valve seat, the difference in pressure between said lubricant groove and said discharge chamber during normal compression operation of said compressor being high enough to urge said valve member into sealing engagement with said valve seat to block the communication between said lubricant groove and said discharge chamber.

3. A rotary compressor as defined in claim 1, wherein said valve means including means defining a valve chamber to which said communication passage is open at one end, said valve chamber defining means also defining a second communication passage extending between said valve chamber and said discharge chamber, a valve member disposed in said valve chamber for movement between a first position in which said communication passages are communicated with each other and a second position in which the communication between said communication passages is interrupted, said valve member being in the form of a spool valve member and cooperating with said valve chamber defining means to define first and second pressure spaces adjacent to first and second ends of said spool valve member, and said one end plate being further formed therein with third and fourth communication passages, said third communication passage being so disposed as to communicate said first pressure space with each working chamber when in the final stage of its compression phase, said fourth communication passage being so disposed as to communicate said second pressure space with each working chamber when in the initial stage of its compression phase.

4. A rotary compressor as defined in claim 3, wherein said valve means further include means resiliently biasing said valve member toward said first position, said predetermined pressure difference being determined by said resiliently biasing means.

5. A rotary compressor as defined in claim 4, wherein said resiliently biasing means comprises a compression spring disposed in said second pressure space and acting on said second end of said spool valve member.

6. A rotary compressor comprising:

a housing having an inner peripheral surface;

first and second end plates sealingly secured to the opposite ends of said housing to cooperate therewith to define a bore;

a rotor mounted eccentrically in said bore for rotation therein and provided with a plurality of vane grooves formed in the outer peripheral surface of said rotor;

vanes slidably mounted in said vane grooves, respectively;

said inner peripheral surface, said end plates, said rotor outer surface and said vanes cooperating to define a plurality of working chambers the volumes of which are varied during rotation of said rotor, each cycle of revolution of each working chamber about the axis of said rotor including intake and compression phases in which the volume of the working chamber is gradually expanded and gradually decreased, respectively;

an intake port means open to said bore and so disposed as to be communicated with the working chambers when they are in their intake phases;

a discharge port means open to said bore and so disposed as to be communicated with the working chambers when they are in the final stages of their compression phases;

means cooperating with one of said end plates to define a discharge chamber and a lubricant reservoir communicated therewith, said discharge chamber being communicated with said discharge port means, said lubricant reservoir being provided at the bottom of said discharge chamber;

said one end plate being provided with a lubricant groove formed in the surface thereof facing to said rotor, said lubricant groove being disposed such that the inner end portions of the vane grooves pertaining to vanes which define working chambers when in their intake phases are communicated with said lubricant groove, said lubricant groove being adapted to be supplied with lubricant from said lubricant reservoir;

said one end plate being also formed therein with a passage for the communication of said lubricant groove with said discharge chamber so that said lubricant groove and thus the inner end portions of respective vane grooves are supplied with fluid pressure from said discharge chamber;

valve means operative to interrupt the communication between said lubricant groove and said discharge chamber during normal compression operation of said compressor;

said valve means including means defining a valve chamber to which said communication passage is open at one end, said valve chamber defining means also defining a second communication passage extending between said valve chamber and said discharge chamber; a valve member disposed in said valve chamber for movement between a first position in which said communication passages are communicated with each other and a second position in which the communication between said communication passages is interrupted, said valve member being responsive to variation in the difference in pressure between two working chambers and moved to one of said two positions, the arrangement being such that said valve member is moved to said first position when said pressure difference is less than a predetermined value and such that said valve member is moved to said second position when said pressure difference exceeds said predetermined value;

said valve member being in the form of a spool valve member and cooperating with said valve chamber defining means to define first and second pressure spaces adjacent to first and second ends of said spool valve member, and said one end plate being further formed therein with third and fourth communication passages, said third communication passage being so disposed as to communicate said first pressure space with each working chamber when in the final stage of its compression phase, said fourth communication passage being so disposed as to communicate said second pressure space with each working chamber when in the initial stage of its compression phase.

7. A rotary compressor as defined in claim 6, wherein said valve means further include means resiliently biasing said valve member toward said first position, said predetermined pressure difference being determined by said resiliently biasing means.

8. A rotary compressor as defined in claim 6, wherein said resiliently biasing means comprises a compression spring disposed in said second pressure space and acting on said second end of said spool valve member.

* * * * *